United States Patent [19]

Cox

[11] Patent Number: 4,465,276

[45] Date of Patent: Aug. 14, 1984

[54] EXERCISE APPARATUS WITH RELATIVELY ROTATABLE ARMS

[75] Inventor: Alan W. Cox, Bray, England

[73] Assignee: Black & Decker Inc., Newark, Del.

[21] Appl. No.: 373,701

[22] Filed: Apr. 30, 1982

[30] Foreign Application Priority Data

Apr. 30, 1981 [GB] United Kingdom ..... 8113366
Sep. 28, 1981 [GB] United Kingdom ..... 8129220

[51] Int. Cl.[3] ..... A63B 21/32
[52] U.S. Cl. ..... 272/137; 272/141
[58] Field of Search ..... 272/135, 140, 143, 137, 272/131, 132, 125, 141, 130, 67; 267/153, 21

[56] References Cited

U.S. PATENT DOCUMENTS

| | | | |
|---|---|---|---|
| Re. 23,744 | 11/1953 | Magida | 272/132 |
| 2,562,501 | 7/1951 | Madden | 267/21 |
| 2,973,962 | 3/1961 | Griffen | 272/67 |
| 3,315,959 | 4/1967 | Carnielli | 272/132 X |
| 3,515,384 | 6/1970 | Alexander | 272/132 |
| 4,171,802 | 10/1979 | Stoecker | 272/143 |
| 4,374,588 | 2/1983 | Ruggles | 272/132 |
| 4,385,760 | 5/1983 | Mattox et al. | 272/132 X |

*Primary Examiner*—Richard J. Johnson
*Assistant Examiner*—William H. Honaker
*Attorney, Agent, or Firm*—Edward D. Murphy; Harold Weinstein; Ronald B. Sherer

[57] ABSTRACT

Exercise apparatus comprises a knuckle joint (3) incorporating connectors (4, 5) from which extend the arms (1, 2) of the apparatus. The knuckle joint (3) comprises two housings each accommodating two resilient masses (55) in arcuate channels (12, 13). Relative angular movement of the arms (1, 2) about the axis of the knuckle joint compresses the masses (55) by means of arcuate wall portions (22, 23) located in the channels. Each connector is releasably coupled by a pin (47) or pawl (96) to a part of one housing and by releasing the coupling the arm extending from the connector can be rotated about the housing axis without compressing the resilient mass.

12 Claims, 31 Drawing Figures

EXERCISE APPARATUS WITH RELATIVELY ROTATABLE ARMS

FIELD OF THE INVENTION

This invention relates to exercise apparatus and has particular but not exclusive reference to exercise apparatus for both general and specialised use and for muscle building and general physical development.

BACKGROUND OF THE INVENTION

To be suitable for such use, exercise apparatus must be safe and easy to use and should be capable of providing a wide range of exercises, preferably a wide range of graded exercises.

SUMMARY OF THE INVENTION

According to the present invention, exercise apparatus comprises first and second rigid arm means interconnected at one end by a device including resilient means for resisting angular movement about the device of one arm means relatively to the other, and in which one at least of the arm means is uncouplable from the device for the purpose of adjusting the angular position of the arm relatively to the device without stressing the resilient means, the arm being re-couplable to the device after the adjustment.

The device preferably comprises a pivoted axis about which angular movement takes place.

The apparatus may comprise two spaced assemblies each comprising first and second rigid arm means interconnected as aforesaid, the assemblies being joined together by cross members located at or adjacent the free ends of the rigid arms.

In one embodiment of the invention, the or each interconnection device comprises a housing containing a helical spring that is stressed as one arm means is moved angularly relatively to the other arm means. One of the arm means may be detachably coupled to the housing in any one of a number of alternative angular positions. Detachment allows the angular position of the arm means to be changed without stressing the resilient means.

In one embodiment of the invention, the device includes a housing accommodating a mass of resilient material and means for compressing the mass on angular movement of one arm relatively to the other arm.

One of the arms is operatively connected to the housing and the other arm is operatively connected to the said means.

In one embodiment of the invention, the housing and the means are rotatable about an axis, the mass of resilient material being disposed arcuately about that axis.

Preferably, the housing includes an arcuate channel in which the mass is located.

In one embodiment of the invention, the housing includes two arcuate channels disposed concentrically with respect to the said axis, each channel accommodating a mass of resilient material.

The means for compressing the mass of resilient material may comprise a component that extends into arcuate channel. Where the housing includes two such arcuate channels, two components are provided, each of which extends into a different one of the arcuate channels.

Preferably, the device comprises two housings, each accommodating at least one mass of resilient material, and in which each arm is operatively connected to one housing and to means in the other housing for compressing the mass of resilient material therein.

In one embodiment of the invention, the device comprises two socket connectors for coupling the arms to the device, each socket connector including an extension carrying at least one projection, and two housings each accommodating at least one mass of resilient material, the projections of the socket connectors each being adapted to compress the mass in a different one of the housings.

The resilient material may be a resilient plastics material and may be of cellular, for example micro-cellular or non-cellular material.

Each arm means may include a bifurcated portion between the branches of which the interconnection device is located. The portion may be adapted to receive a locking device for locking the arm to the device in any one of a number of different angular positions.

The bifurcated portion may be detachably secured to the arm means by means of a connector joined to the portion and able to swivel in a manner such that the angular relationship between the arm and the portion may be changed from one value to another.

The length of each rigid arm means may be adjustable in which case the arm means may be of a telescopic form.

Additionally, where the exercise device comprises two spaced assemblies, the cross members may be adjustable in a manner such that the distance between the assemblies can be varied.

Alternatively, the length of each arm means may be fixed and the apparatus provided with sets of arm means each set having arm means of a different length.

In one embodiment comprising two assemblies, the arm means may be of U-shaped form, the ends of the vertical limbs of the U being coupled to the interconnection device and the base of the U forming the cross member referred to above. In this case, the apparatus may include several sets of U-shaped arm means with vertical limbs of different lengths and bases also of different lengths.

BRIEF DESCRIPTION OF THE PREFERRED EMBODIMENTS

By way of example only, embodiments of the invention will now be described in greater detail with reference to the accompanying drawings of which:

Figure 1:
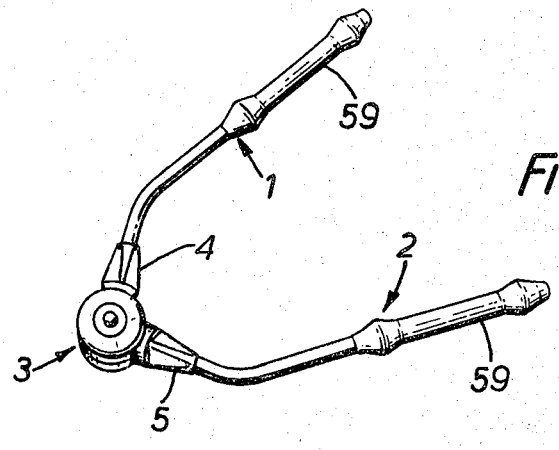
FIG. 1 is a perspective view of one embodiment.
Figure 8:
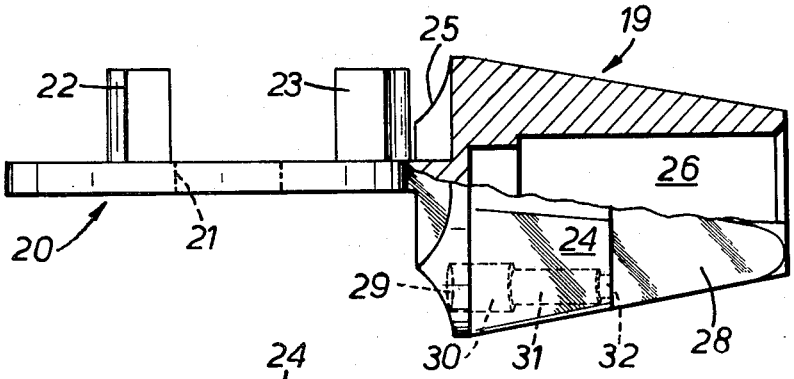
Figure 10:
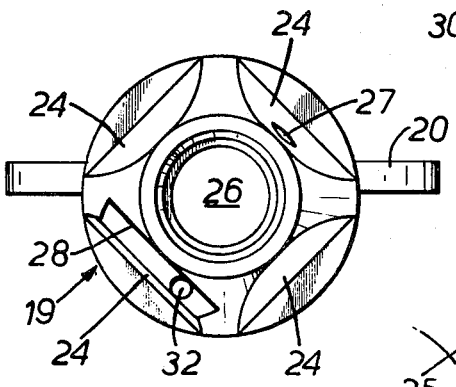
Figure 11:
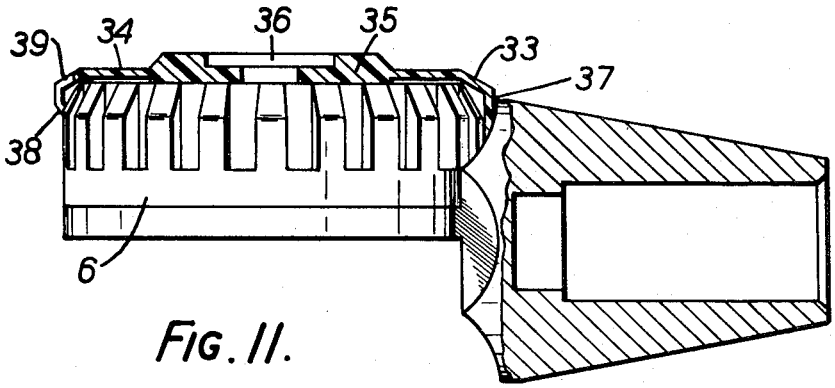
Figure 12:
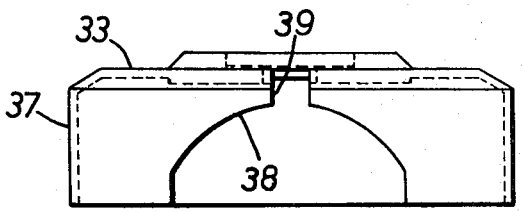
Figure 13:
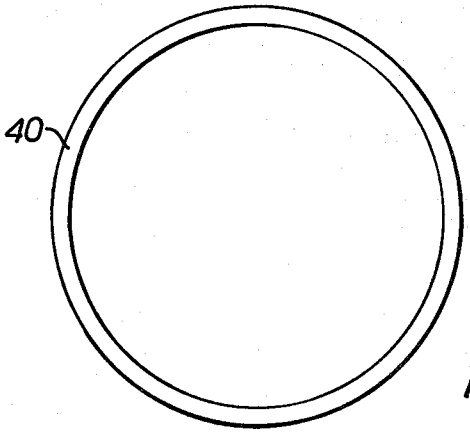
Figure 14:
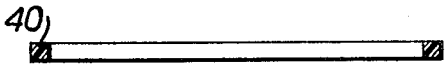
Figure 15:
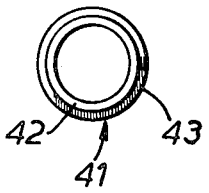
Figure 16:
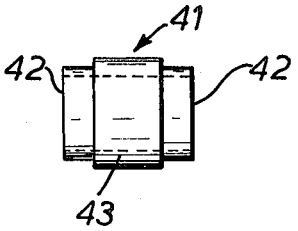
Figure 17:
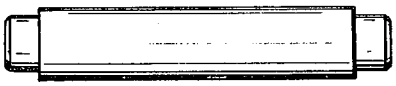
Figure 19:
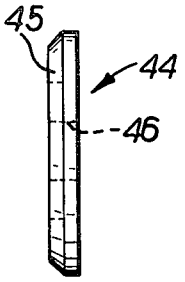
Figure 18:
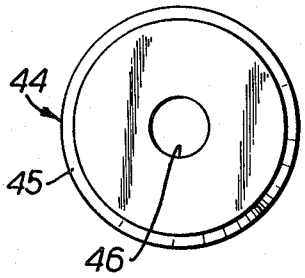
Figure 20:
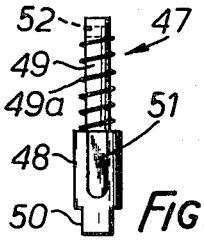
Figure 21:
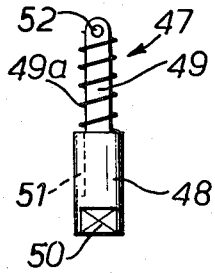
Figure 22:
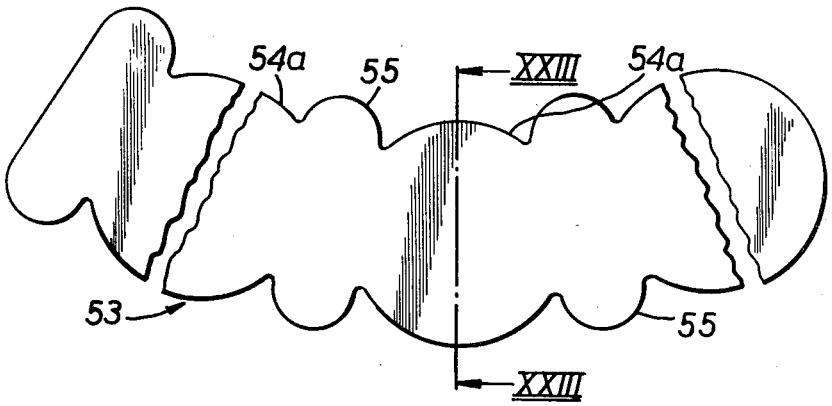
Figure 23:
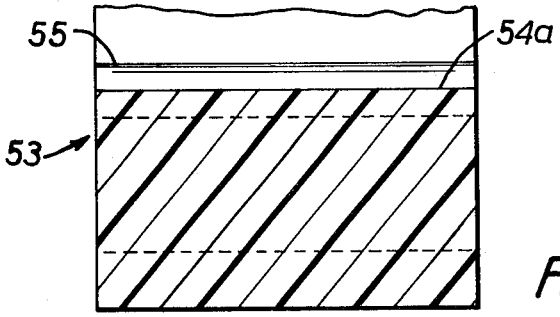
Figure 24:
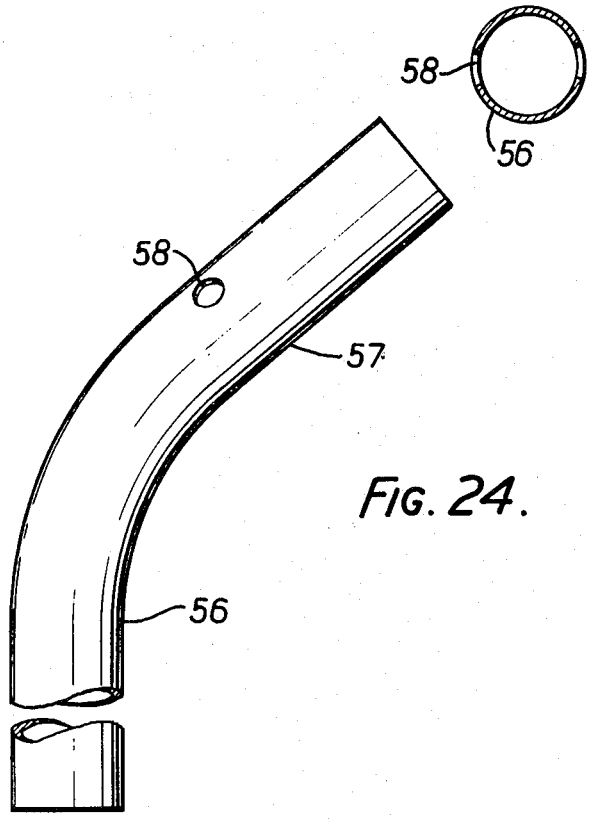
Figure 25:
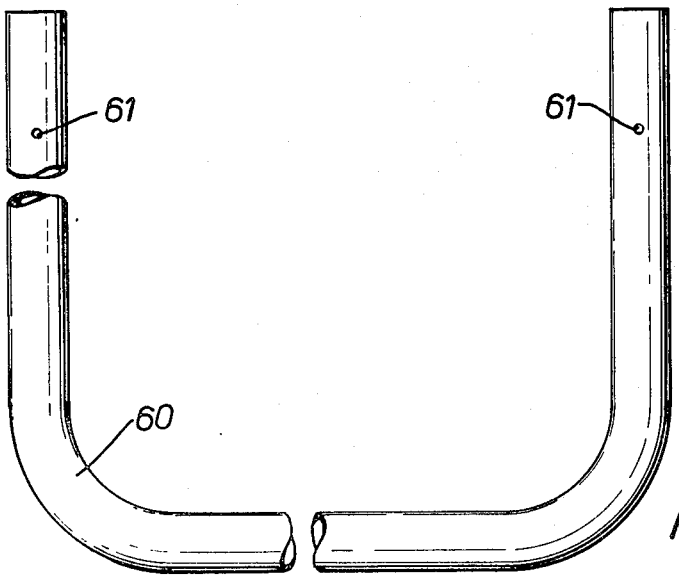
Figure 26:
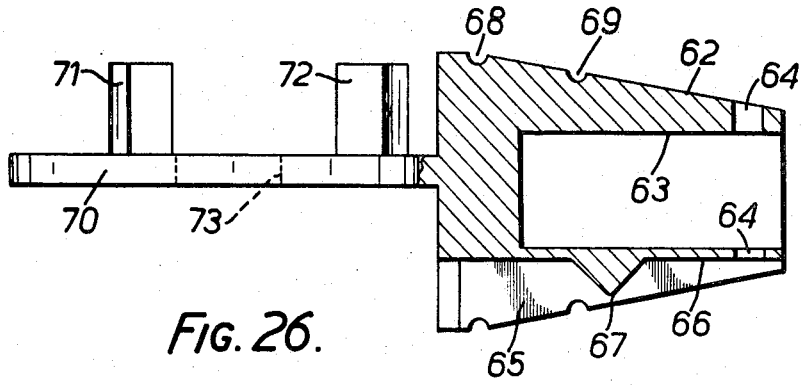
Figure 27:
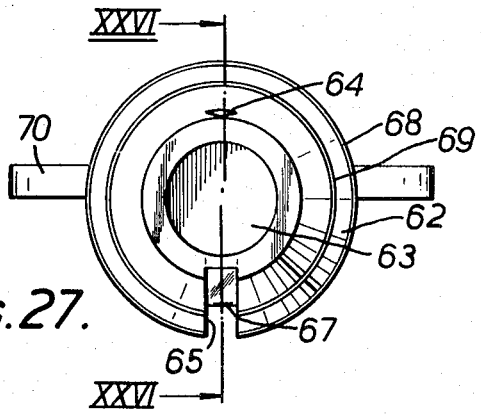
Figure 28:
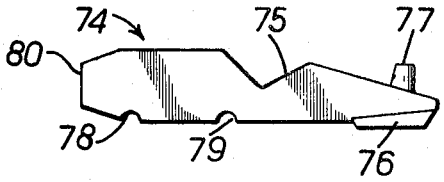
Figure 29:
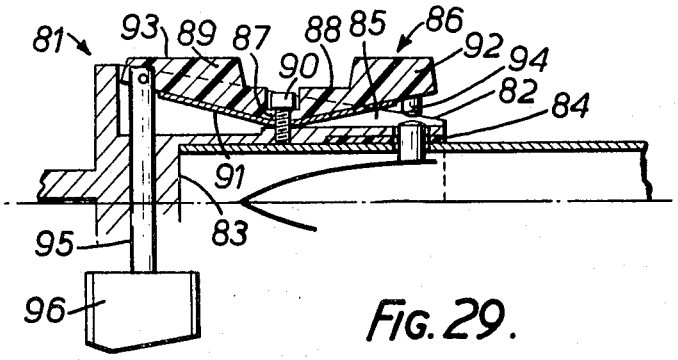
Figure 30:
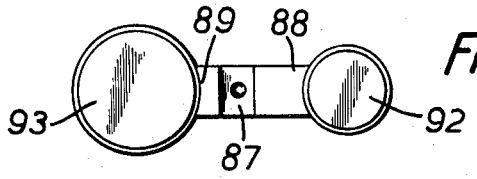
Figure 31:
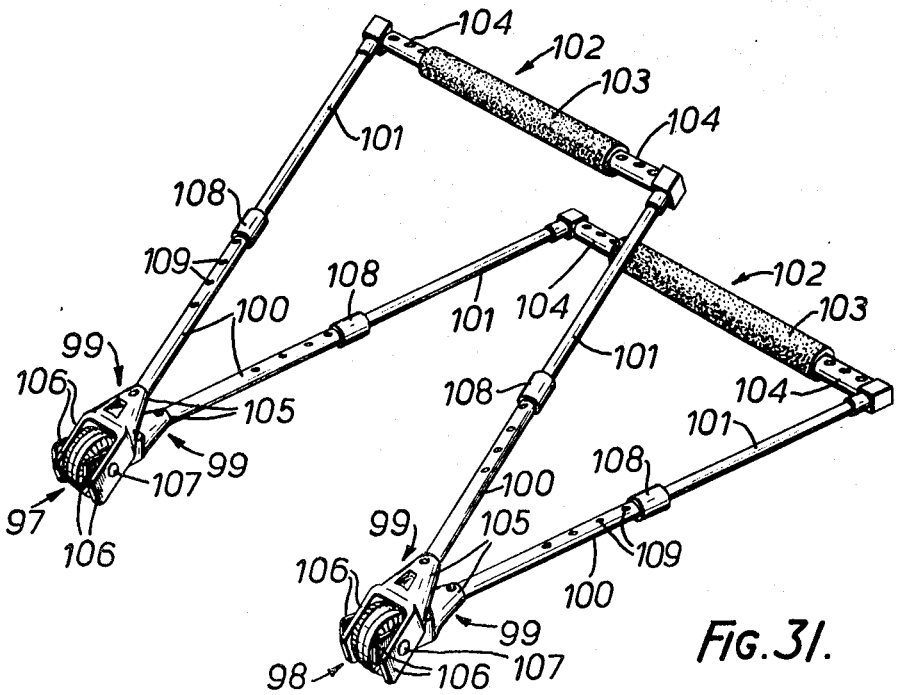

FIGS. 7, 8, 9 and 10 are, respectively, plan view, side view partly in section, scrap view and end view of another part, FIG. 11 corresponds with FIG. 8 but shows, additionally, a further part, FIG. 12 is a side view of the further part, FIGS. 13 and 14 are, respectively, plan and side view of another part, FIGS. 15 and 16 are, respectively, end and side view of another part, FIG. 17 is a side view of another part, FIGS. 18 and 19 are, respectively, end and side view of yet another part, FIGS. 20 and 21 are, respectively, front and side view of a catch assembly, FIG. 22 is a plan view, on an enlarged scale, of yet another part, FIG. 23 is a section on the line XXIII—XXIII of FIG. 22, FIG. 24 is a side view of a component of an arm assembly, FIG. 25 is a side view of an alternative form of the component of an arm assembly, FIG. 26 is a section on the line XXVI—XXVI of FIG. 27, FIG. 27 is an end view of an alternative form of the part shown in FIG. 8, FIG. 28 is a side view of a further component, FIG. 29 is a section of part of an alternative form of one of the components of the embodiment of FIG. 1, FIG. 30 is a plan view of one of the parts of the component shown in FIG. 29, and, FIG. 31 is a perspective view of another embodiment.

DETAILED DESCRIPTION OF THE PREFERRED EMBODIMENTS

The exercise apparatus shown in FIG. 1 comprises arm assemblies 1, 2 pivotally interconnected by a device in the form of a knuckle joint 3 from which extend connectors 4, 5 that form part of the arm assemblies 1, 2. The knuckle joint 3 contains resilient means that are compressed when the arm assemblies 1, 2 are moved relatively to one another.

Figure 4:
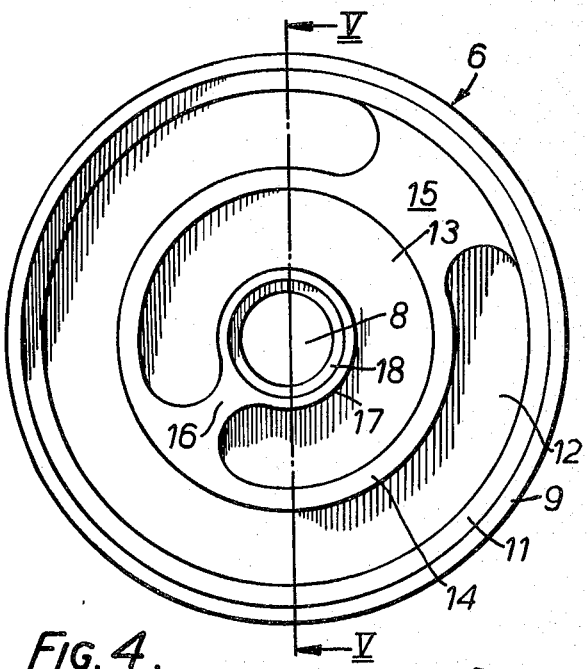
FIG. 4 is a plan view of another part of the apparatus on a larger scale.
Figure 5:
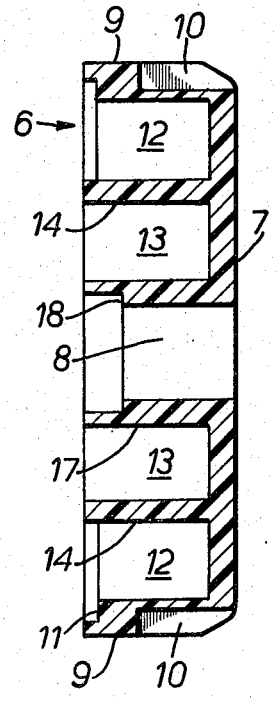
FIG. 5 is a section on the line V—V of FIG. 4.
Figure 6:
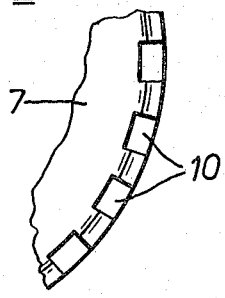
FIG. 6 is a scrap view of a detail of the part shown in FIG. 4.
Figure 2:
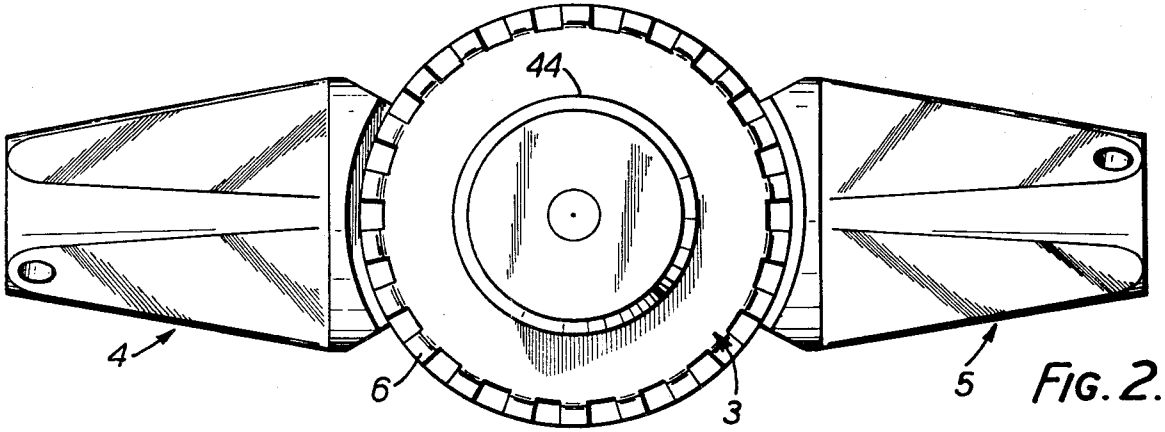
FIG. 2 is a plan view partly in section of a part of the apparatus.
Figure 3:
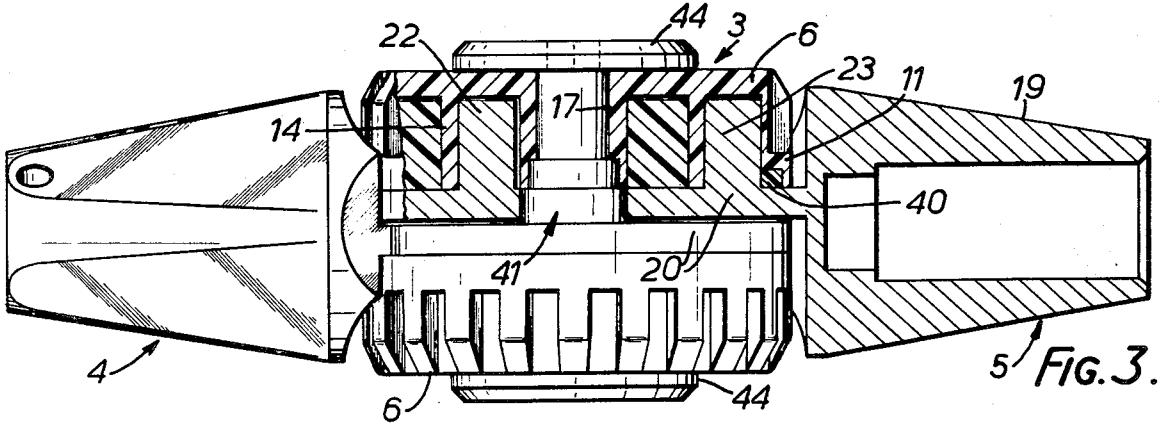
FIG. 3 is a side view partly in section of the part shown in FIG. 2.
Figure 7:
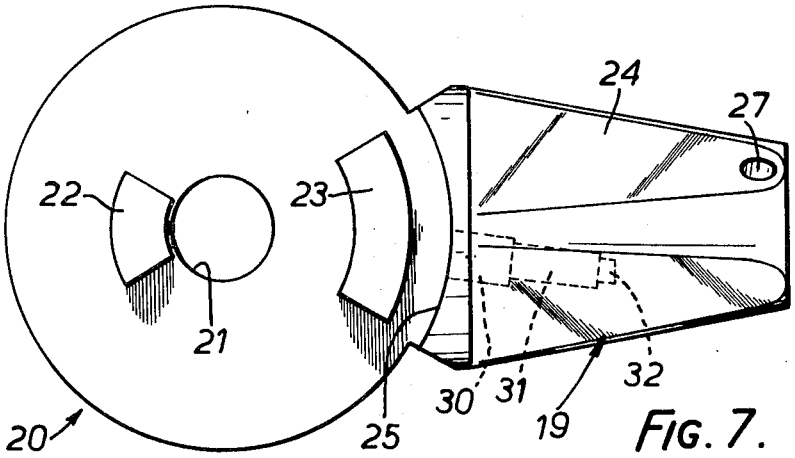

The knuckle joint 3 shown on a larger scale in FIGS. 2 and 3 comprises two metal housings or cap members 6 each of similar cup-like form. One of the members 6 is shown in FIGS. 4 and 5 and it can be seen that the member has an end wall 7 apertured centrally as at 8 and also has an outer peripheral wall 9 notched externally at a series of equispaced intervals. The notches 10 extend along the wall 9 and terminate at the edge of the end wall 7.

The peripheral wall 9 is stepped as at 11.

Internally, each cap member 6 has arcuate channels 12, 13 concentric with the aperture 8 and arranged one within the other as can be seen from FIG. 4. The channels 12, 13 are separated by an internal wall 14. The ends of the channel 12 being separated by a radially-outwardly extending portion 15 of the wall 14 while the ends of the channel 13 are separated by a radially-inwardly extending portion 16 of the wall 14. The portion 16 merges into an annular wall 17 surrounding the aperture 8 and stepped as at 18.

The connectors 4, 5 are identical in form and one is shown in more detail in FIGS. 7–10. Each connector comprises a socket portion 19 from one end of which extends a circular disc portion 20 apertured centrally as at 21 and carrying two arcuate walls 22, 23. As can be seen from FIG. 7, the walls 22, 23 are concentric with the aperture 21, are located at diametrically-opposed locations with respect to the aperture 21, and wall 22 is closer to the aperture 21 than is the wall 23. The radial positions of the walls 22, 23 are such that when the parts of the knuckle joint are assembled, the walls 22, 23 of one socket locate, respectively, in the arcuate channels 12, 13 of an adjacent cap member 6 as can be seen from FIG. 3.

The socket portion 19 is of generally conical shape with "flats" 24 on the curved surface of the cone. The base of the cone is of arcuate shape as indicated at 25, the disc portion 20 extending centrally from the curved base 25.

The socket portion 19 has a central, longitudinal stepped blind bore 26 with which communicate radial holes 27 located at the outer end of the portion and in diametrically opposed positions.

Figure 9:
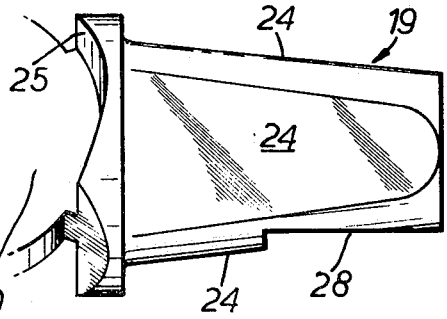

One of the "flats" 24 is cut away as indicated at 28 in FIG. 9 to give access to one end of circular cross section passageway 29 parallel with the bore 26 and having lengths 30, 31 and 32 of different diameters as shown in FIG. 8.

FIG. 11 corresponds with FIG. 8 but shows, additionally, a cap cover 33 of a plastics material. The knuckle joint, when assembled, has two such cap covers but these have been omitted from FIGS. 2 and 3 for the sake of clarity.

Each cap cover 33 conforms in general shape to a cap member 6 being of cup-like form dimensioned to fit over the cap member 6 as indicated in FIG. 11. The end wall 34 of the cap cover 33 is thickened centrally as shown at 35, the thickened portion having a central stepped bore 36. In addition, the peripheral wall 37 of the cap cover 33 has a cut-away 38, the latter including an extension 39.

FIGS. 13 and 14 show a ring 40 of a plastics material for example nylon dimensioned to be accommodated in the step 11 in a cap member 6 as will be described later and which is shown in FIG. 3.

FIGS. 15 and 16 show a centre bush 41 having end portions 42 of reduced diameter as compared with the middle portion 43. The function and location of the bush 41 will be described later. The bush 41 is of a plastics material for example nylon.

FIG. 17 shows a spindle.

FIGS. 19 and 20 show a washer 44 having a frusto-conical face 45 and a central hole 46. The function and location of the washer 44 will be described later.

FIGS. 20 and 21 are, respectively, front and side elevation of a catch assembly comprising a locking pin 47 with a cylindrical head 48 of greater diameter than that of the stem 49 of the pin. The head 48 has diametrically-opposed "flats" 50 and a longitudinal keyway 51. The stem has a crossbore 52 for the reception of a split ring (not shown). A helical spring 49*a* encircles the seem 49 of the pin 47.

Located in the channels 12, 13 of each cap member 6 are masses of a suitable resilient plastics material for example a polyurethane which may be that known under the Trade Mark "PRESCOLLAN". FIGS. 22 and 23 show one form the resilient mass may take. The mass 53 is of strip-like form with enlarged gently-curved portions 54*a* along its length separated by portions 55 whose edges are more sharply curved.

Four such masses 53 are required for a knuckle joint, two of the masses each being dimensioned to fit into one of the longer channels 12 of the cap members 6 and the remaining two each being dimensioned to fit into one of the smaller channels 13. The depth of a strip is equal with the depth of a channel whilst the maximum width at the portions 55 is equal to the width of a channel. The overall length of the masses is such that each is accommodated in a channel with sufficient room being left to receive an arcuate wall. The contour of the mass 53 described enables it to be compressed rather more easily initially than subsequently. Initially, there is some space in a channel and this accommodates the initial deformation of the mass.

Variations of the configuration of the mass require different degrees of effort during the initial stages of compression of the mass.

The arm assemblies 1, 2 each comprise an elongate handle 56 of tubular steel as shown in FIG. 24, the handle having an end portion 57 inclined with respect to the remainder of the handle. Adjacent the outer end of the inclined end portion 57 is a hole 58 in the curved wall of the tube.

Over a part of its length, the handle 56 may have a covering of a resilient material shaped to enable a user to grasp the handle more easily and to accommodate other parts of a user's body in a comfortable manner. Such coverings are shown in FIG. 1 at 59.

To assemble the parts described above, resilient masses 53 are first accommodated in the channels 12, 13 of two end cap members 6 gaps being left at one end of each recess. Rings 40 are then positioned in the steps 11 of the cap members 6.

A catch assembly—FIGS. 20 and 21—is then mounted in each connector 4, 5. This is done by inserting that end of the locking pin 47 with the cross bore 52 into the largest diameter end of the passageway 29 until that end projects from the open end of the smallest diameter part 32 and then connecting a split ring through the bore 52. The spring 49 is accommodated in the centre portion 31 and is compressed slightly to maintain the catch with the "flats" 50 projecting from the open end of the largest diameter portion 30 of the passageway 49.

The centre bush 41 is then located in the bore 8 of one of the end cap members 6, the centre portion 43 of the bush being accommodated, in part, by the stepped part 18 of the bore 8.

The first of the connectors 4, 5 is positioned with its arcuate walls 22, 23 extending into the gaps referred to above left in the channels 12 and 13, the aperture 21 locating over the centre part 43 of the bush 41. A thin annulus of a suitable anti-friction material is then placed over the exposed face of the disc portion 20 of the connector.

The other connector is then mounted over the centre bush 41, the arcuate walls of the other connector pointing away from the connector already in position.

To facilitate the positioning of the connector, it is necessary to withdraw the projecting end of the locking pin 47 by pulling the split ring against the action of the spring 49*a*. When the connector is correctly positioned, the split ring is released so enabling the pin to move into a position in which the "flats" 50 engage in one of the notches 10. Although not shown in the drawings, some means will be provided for preventing rotation of the catch assembly in the passageway 29. The means may be "key" or a grab screw working in a groove in the head of the locking pin.

The second cap member is then located over the other connector with the arcuate walls 22, 23 thereof located in the gaps referred to above in the channels 12, 13 of the second end cap.

To enable the second cap member to be correctly positioned, the projecting end of the locking pin 47 on the first of the connectors is withdrawn and then released when the cap member is in its correct position. The "flats" 50 on the locking pin then engage in one of the notches 10 in the second cap member.

The spindle shown in FIG. 17 is then passed through the centre bush after which the cap covers 33 are placed over the end cap members as shown in FIG. 11.

The knuckle joint assembly is then held together by caps with spring fingers that lock on to the ends of the spindle.

If cap covers are not used, the washers shown in FIGS. 18 and 19 are located on the cap members before the caps with spring fingers are placed in position.

U-shaped spring retainers are then placed into the end portions 57 of the arms 1, 2, the arms of the retainers having studs one of which locates in the hole 58 in the wall of the end portions 57.

The inclined end portions 57 of the handles 56 are then inserted into the bores 26 of the socket portions 19 so displacing inwardly the limbs of the spring retainers and enabling the studs to engage both the holes 58 in the handles and the holes 27 in the socket portions when these holes are aligned so securing the handles to those portions.

The assembly is now as shown in FIG. 1. Movement of the arm assemblies 1, 2 towards each other results in the compression of the resilient masses 48 in the channels 12, 13 by the arcuate walls 22, 23. It will be appreciated that each arm is coupled by a catch assembly to one cap member and by a connector whose arcuate walls 22, 23 are located in the channels 12, 13 of the other cap member.

The initial angular positions of the arm assemblies 1, 2 can be changed without stressing the resilient masses merely by uncoupling each arm from its associated cap member by withdrawing the flats of the catch assembly from engagement with the notches and rotating the arms to their new positions. In this manner it is possible so to orientate the arm assemblies that either closing or opening movement thereof stresses the resilient masses.

In addition the arms 56 can be rotated through 180° in the bores 26 of the socket members 19 so giving additional variations.

It is also possible to replace one of the arms 56 by a straight section of tube the free end of that tube then being inserted into the bore of the socket member of another knuckle joint whose other socket member receives a handle similar to handle 56. Such an assembly provides exercise apparatus that enables other parts of the human body to be exercised.

FIG. 25 shows a handle frame 60 that can be used to couple together the knuckle joints. The handle 60 is of tubular generally U-shaped configuration the base of the U having a covering (not shown) of a resilient material similar to covering 59 shown in FIG. 1.

The free ends of the handle 60 have diametrically opposed holes 61 in which locate the studs of a spring retainer similar to that described above, the studs engaging the bores 26 in the connectors in a manner similar to that described above.

Two handles 60 are employed in conjunction with two knuckle joints to provide exercise apparatus that enables a further range of exercises to be carried out.

It will be apparent from what has been said above that an arm can be readily withdrawn from a connector by depressing the studs located in the bores 27 until the studs clear the bores and then withdrawing the arms from the bore 26 of the connector. In the embodiment shown in FIGS. 26, 27 and 28, depression of the studs is effected by pressure on the pad 76 which pivots the lever 74 and causes the stud 77 to enter the hole 58 in the arm and disengage the stud on the spring retainer.

Shown in FIGS. 26 and 27 is another form of connector that could be used in place of the connector shown in FIGS. 7–10. The connector shown in FIGS. 26 and 27 is generally similar to that shown in FIGS. 7–10 having a socket portion 62 of generally, frusto-conical form with a blind bore 63, the wall of the bore being apertured at diametrically opposed positions 64 adjacent its end. The socket portion also has a longitudinally-extending slot 65. The base 66 of the slot has a pivot 67 formed in it about midway of its ends. Spaced circumferential grooves 68, 69 are formed in the surface of portion 62 as shown.

Extending from the socket portion 62 is a disc like portion 70 similar to portion 20 of connector 19 shown in FIGS. 7–10 and carrying arcuate walls 71, 72 identical with the arcuate walls 22 and 23 described above. Portion 70 has a central aperture 73 corresponding with aperture 21 referred to above.

As can be seen from FIGS. 26 and 27 the curved outer surface of the socket portion 62 is smooth and is not formed with "flats" as is socket portion 19 described above.

Associated with the connector shown in FIGS. 26 and 28 is a lever 74 shown in FIG. 28. The lever 74 is of strip-like form and fits into the slot 65 being recessed as at 75 to form a surface that coacts with the pivot 67 to allow the lever to rock. At one end one face of the lever has a pad 76 secured to it, while the opposite face carries a stud 77. Grooves 78, 79 formed in the lever register with the grooves 68, 69 when the lever is located in the slot 65 with the recess 75 seated on the pivot 67. The lever 74 is held in the slot by resilient bands, for example O-rings, located in the grooves 68, 69 and 78, 79.

The connector shown in FIGS. 26 and 27 is usable in place of the connector shown in FIGS. 7–10, the pivoted lever 74 taking the place of the catch assembly shown in FIGS. 20 and 21 as the means for securing the connector to a cap member. Inward pressure on the pad 76 disengages the end 80 of the lever from a notch 10.

A further form of connector is shown in part in FIG. 29. The connector 81 is generally similar in overall shape to that described above with reference to FIGS. 26 and 27 having a frusto-conical portion 82 with a blind bore 83, the wall of which is apertured at diametrically-opposed positions one aperture only being shown in FIG. 29 and referenced 84.

The connector has a longitudinal slot 85 which accommodates a double-armed lever 86 whose mid-section comprises a flexible web 87 interconnecting the arms 88, 89 of the lever. Passing through the web 87 is a screw 90 that secures the lever to the connector in the position shown in FIG. 29. Located between the lever 86 and the base of the slot 85 is a leaf spring 91 whose limbs extend beneath the arms 88, 89 of the lever and bias them upwardly (as viewed in FIG. 29).

The free ends of the arms 88, 89 have enlarged pressure surfaces 92, 93 respectively as can be seen in FIG. 30. Extending downwardly from beneath surface 92 is a stud 94 aligned with the aperture 84. Beneath the surface 93, the arm 89 has a hole that accommodates one end of a spindle 95 whose other end carries a locking pawl 96 located in a slot (not shown) in the connector and positioned to engage one or other of the notches 10 referred to above.

With the construction just described, it is possible to depressing arms 89 of the lever 85 to disengage the pawl 96 from a notch 10 without also releasing the stud holding the arm in the connector. That release is effected by depressing the other arm 88 of the lever.

It will be evident that sets of arms 56 of different lengths may be used with a knuckle joint thereby enabling a user to "grade" exercises he does. In a similar manner, U-shaped handles 60 with limbs of different lengths can be used with two knuckle joints.

Alternatively, telescopic handles could be used as could U-shaped handles with telescopic limbs. U-shaped handles with different base lengths may also be used. If desired, the limbs of the U-shaped handle could be of a "cranked" shape similar to that of the handle 56.

FIG. 31 shows, in perspective, an embodiment of the invention incorporating some of the features just referred to.

Knuckle joints 97, 98 of similar connection include connectors 99 in the bores of which are located tubular rods 100 with telescopically connected extensions 101 joined at their free ends by cross handles 102 each of a telescopic construction having a central padded portion 103 from which extend connecting portions 104 detachably secured to the ends of the extensions 101.

The connectors 99 are different in form from those described above. They have a frusto-conical portion 105 with a blind bore into which the rods 100 are inserted and locked by means of spring mounted studs that co-operate with holes in the tube walls adjacent the ends thereof.

From the portions 105 extend parallel limbs 106 between the free ends of which extend axles 107 about which the arms of the embodiment pivot. The limbs 106 of the two connectors of a joint are non-symmetrically disposed to allow them to be positioned as shown and to accommodate between them a housing of generally cylindrical form. The housings are of two part construction and accommodates one or more helical springs that are stressed as the parts of the housing rotate relatively to one another about the axles 107.

Each connector 99 is releasably coupled to one housing part by means similar to one or other of the means described above and which enable a connector to be uncoupled and rotated about the axle without stressing the spring or springs within the housing. In that way the positions of the tubes 100 can be adjusted as required by a user.

The extensions 101 are adjustable in effective length and are lockable in a selected position by locking means indicated at 108. The selectable positions are determined by apertures 109 in the tubes 100 and into which extend spring urged studs.

In like manner, the effective lengths of the connecting portions 104 are adjustable so that a user is able to vary the distance between the joints 97, 98

It is also possible to use masses of resilient material of different grades of compressibility or springs of differing strengths. A user might start with easily compressible material or spring and then proceed to material or a spring that requires more effort to compress as his ability improves.

It will be evident that exercise apparatus embodying the invention is able to provide a wide range of different exercises requiring different degrees of effort. A user is thus able to grade the degree of effort to suit his requirements.

I claim:

1. An exercise apparatus, comprising:

a first rigid arm having a first disc portion connected to one end;

a second rigid arm having a second disc portion connected to one end;

said first and second disc portions each having an abutment extending from one side, said disc portions being pivotally connected together with the abutments extending in opposite directions away from each other;

a first cap overlying said first disc portion with the abutment of the latter engaged in said first cap;

a second cap overlying said second disc portion with the abutment of the latter engaged in said second cap;

said caps and said disc portions being pivotal relative to each other about a common pivotal axis;

first resilient means, disposed between said first cap and the abutment of said first disc portion, for resisting relative pivoting between said first cap and said first disc portion in at least one direction;

second resilient means, disposed between said second cap and the abutment of said second disc portion, for resisting relative pivoting between said second cap and said second disc portion in at least one direction;

each cap having a series of notches on the exterior thereof; and a locking member connected to each disc portion and being releasably engageable in any of the notches on the cap overlying the other respective disc portion;

whereby when the locking members are released from the notches the first and second arms can be pivoted about said pivotal axis without resistance from said first and second resilient means, but when the locking members are engaged in selected notches relative pivoting of said arms in at least one direction is progressively resisted by said first and second resilient means.

2. The exercise apparatus of claim 1, wherein said first and second resilient means each comprise a mass of resilient material.

3. The exercise apparatus of claim 2, wherein each mass of resilient material is of strip-like form with enlarged gently-curved portions along its length separated by portions whose edges are more sharply curved to enable each strip-like mass to be compressed more easily initially than subsequently.

4. The exercise apparatus of claim 1, wherein said abutments comprise arcuate walls concentric with said pivotal axis, said caps have arcuate channels therein, said arcuate walls engage in said channels, and each channel accommodates a mass of resilient material which is compressible between an end of that channel and the arcuate wall engaged in that channel.

5. The exercise apparatus of claim 1, wherein each locking member comprises a spring-loaded locking pin.

6. The exercise apparatus of claim 5, wherein each disc portion has extending therefrom a socket portion in which the respective rigid arm is releasably engaged, said socket position having a passageway therein in which said spring-loaded locking pin is mounted.

7. The exercise apparatus of claim 6, wherein said disc portions and said caps have central bores which are pivotally engaged on a center bush.

8. An exercise apparatus, comprising:

first and second rigid members interconnected for relative pivotal movement about a pivotal axis;

each rigid member having a circular disc portion concentric with said pivotal axis;

each disc portion having two arcuate walls extending axially from one side thereof, said two arcuate walls being concentric with said pivotal axis and being located at different radial distances therefrom, and the two disc portions being disposed back to back with their respective arcuate walls extending outwardly in opposite directions;

two cup-like cap members disposed over said disc portions and being coaxial with said pivotal axis;

each cap member having therein two arcuate channels extending concentrically to said pivotal axis at different radial distances therefrom, each of the arcuate channels having one of said arcuate walls extending thereinto;

a mass of resilient material accommodated in each arcuate channel between one end thereof and the arcuate wall extending into that channel;

each cap member having a series of notches formed around the external periphery thereof;

each disc portion having a releasable locking member connected thereto and resiliently biassed to engage the series of notches on the cap member disposed over the other disc portion; and means for pivotally connecting said two disc portions and said two cap members together so that each can pivot about said pivotal axis;

whereby when the locking members are released from said notches said disc portions can be pivoted relative to each other about said pivotal axis without resistance from the masses of resilient material, but when said locking members are engaged in any selected notches relative pivoting of said disc portions, at least in one direction, is progressively resisted by said masses of resilient material.

9. The exercise apparatus of claim 8, wherein the arcuate wall of each disc portion which is at a larger radial distance from said pivotal axis is longer than the other arcuate wall of that disc portion.

10. The exercise apparatus of claim 9, wherein the arcuate channel of each cap member which is at a larger radial distance from said pivotal axis is longer than the other arcuate channel of that cap member.

11. Exercise apparatus, comprising:

first and second rigid arms interconnected at one end by a device including resilient means for resisting angular movement about the device of one arm relatively to the other;

one at least of the arms being uncouplable from said device for the purpose of adjusting the angular position of that arm relatively to said device without stressing the resilient means, the arm so adjusted being recouplable to the device after such adjustment;

said device incorporating a pivotal axis about which angular movement of the arms takes place;

said device comprising two housings each containing a mass of resilient material and means for compressing the mass, one arm being operatively connected to one housing and the compressing means in the other housing, the other arm being operatively connected to the other housing and the compressing means in the one housing; and each arm being releasably coupled to the respective housing by means of a locking member resiliently biassed into engagement with one of a numer of location means of the respective housing.

12. Exercise apparatus, comprising:

a first rigid arm having a disc portion rigidly connected to one end thereof;

a second rigid arm pivotally connected to said disc portion whereby said first and second arms are pivotal relative to each other about a pivotal axis;

said disc portion having an abutment extending from one side thereof;

a cap overlying said disc portion with said abutment engaged in said cap, said cap being pivotal about said pivotal axis relative to said disc portion and said second arm;

resilient means, disposed in said cap and operative between said abutment and said cap, for resisting relative pivoting between said cap and said disc portion in at least one direction; and locking means, connected to said second arm, for releasably engaging any one of a series of location means on said cap for locking said second arm and said cap against relative rotation, release of said locking means enabling said cap to rotate with said first arm relative to said second arm without resistance from said resilient means, whereby the angular position about said pivotal axis of said first arm relative to said second arm can be adjusted without stressing said resilient means.

* * * * *